US006257518B1

(12) United States Patent
Mitsuhashi

(10) Patent No.: US 6,257,518 B1
(45) Date of Patent: Jul. 10, 2001

(54) TENSION APPARATUS AND TENSION SYSTEM

(75) Inventor: Takashi Mitsuhashi, Gunma (JP)

(73) Assignee: Ogura Clutch Co., Ltd. (JP)

( * ) Notice: Subject to any disclaimer, the term of this patent is extended or adjusted under 35 U.S.C. 154(b) by 0 days.

(21) Appl. No.: 09/369,698

(22) Filed: Aug. 6, 1999

(30) Foreign Application Priority Data

Aug. 13, 1998 (JP) ..... 10-228840

(51) Int. Cl.[7] ..... B65H 59/16

(52) U.S. Cl. ..... 242/419.9; 242/150 M; 242/155 M; 700/130

(58) Field of Search ..... 242/147 M, 150 M, 242/155 M, 419.8, 419.9, 131.1; 700/126, 130, 136, 143

(56) References Cited

U.S. PATENT DOCUMENTS

| | | | | |
|---|---|---|---|---|
| 2,907,535 | * | 10/1959 | Mindheim et al. | 242/150 M X |
| 3,034,744 | | 5/1962 | Bancroft . | |
| 3,797,775 | * | 3/1974 | White | 242/155 M |
| 4,186,898 | * | 2/1980 | Wilson et al. | 242/150 M X |
| 4,313,578 | * | 2/1982 | Van Wilson et al. | 242/150 M X |
| 4,666,096 | * | 5/1987 | Heel et al. | 242/486.7 |
| 5,421,534 | * | 6/1995 | Arnold et al. | 242/419.8 |
| 5,975,745 | * | 11/1999 | Oishi et al. | 700/126 |
| 6,029,923 | * | 2/2000 | Ishimaru et al. | 242/366 |

FOREIGN PATENT DOCUMENTS 7-37745 2/1995 (JP) .

* cited by examiner

*Primary Examiner*—Michael R. Mansen
(74) *Attorney, Agent, or Firm*—Blakely Sokoloff Taylor & Zafman

(57) ABSTRACT

A tension apparatus having a mechanical section, storage unit, output torque calculation section, and exciting current calculation section is disclosed. The mechanical section has an electromagnetic brake driven by an exciting current to generate an output torque and applies a tension to a material in continuous form, which is being wound and stretched, in accordance with the output torque of the electromagnetic brake. The storage unit stores actually measured characteristics between an exciting current value and the output torque of the electromagnetic brake in advance. The output torque calculation section obtains the output torque of the electromagnetic brake in correspondence with an input tension instruction value. The exciting current calculation section obtains an exciting current value of an exciting coil, which is necessary to generate the output torque of the electromagnetic brake, by looking up the storage unit.

16 Claims, 4 Drawing Sheets

TENSION APPARATUS AND TENSION SYSTEM

FIELD OF THE INVENTION

The present invention relates to a tension apparatus having an electromagnetic brake for applying a tension to a material in continuous form such as a fibrous yarn, or a wire or tape of metal material or the like in winding or stretching the material in continuous form, and a tension system using this tension apparatus.

A tension apparatus used in textile machinery generally comprises an electromagnetic brake actuated as a thread such as a yarn, twist yarn, or double yarn travels, a tension roller fitted on the rotating shaft of the electromagnetic brake, on which a thread is spirally wound, and a pair of large-diameter tenser discs having cooperative surfaces which oppose each other and sandwich the thread between them. A thread handling area is formed from the inlet guide to the outlet guide through the pair of tenser discs and tension roller.

Conventionally, in a tension apparatus of this type, a tension is applied to a material in continuous form such as a thread using a built-in contact or non-contact electromagnetic brake in winding or stretching the material in continuous form. The output torque of the electromagnetic brake is generated in correlation to the exciting current to the electromagnetic brake. A tension based on the product of the output torque of the electromagnetic brake and the radius of the tension roller having the shape of a winding disc or column acts on the material in continuous form. The tension to the material in continuous form is increased/decreased by changing the output torque generated by the electromagnetic brake, i.e., the exciting current to the electromagnetic brake.

A single or a number of tension apparatuses are simultaneously used. For each tension apparatus, the exciting current vs. output torque characteristics of the electromagnetic brake are commonly set on the basis of the design specifications. The value of the exciting current corresponding to the desired output torque is determined using the common exciting current vs. output torque characteristics and supplied to the electromagnetic brake.

More specifically, when an instruction value is given, the tension apparatus calculates the necessary output torque of the electromagnetic brake in accordance with the input instruction value. Subsequently, the value of the exciting current is determined from the resultant output torque in accordance with the common exciting current vs. output torque characteristics and supplied to the electromagnetic brake.

However, according to the tension apparatus with this arrangement, exciting current vs. output torque characteristics of electromagnetic brakes are set commonly for all apparatuses on the basis of the design specifications of the tension apparatus although the individual built-in electromagnetic brakes have variations in generated torque (output torque is represented as a function of generated torque). For this reason, a desired tension cannot be accurately obtained in accordance with the input tension instruction value.

Hence, when a number of tension apparatuses are to be simultaneously used at the same tension, a uniform tension cannot be applied to a material in continuous form even when the same tension instruction value is given to the tension apparatuses. For example, when a tension is applied to a yarn by a warping creel, the fabric woven by a weaving machine is subjected to bowing.

To avoid this problem, as shown in FIG. 7, a plurality of instruction units 2-1 to 2-N are provided in correspondence with tension apparatuses 1-1 to 1-N, and individual tension instruction values TEspl to TEspN are given to the tension apparatuses 1-1 to 1-N from the instruction units 2-1 to 2-N through transmission lines 3-1 to 3-N, respectively. With this arrangement, when the tension instruction values TEsp1 to TEspN that are individually finely adjusted in advance are given to the tension apparatuses 1-1 to 1-N, respectively, the tension apparatuses 1-1 to 1-N can be simultaneously used at the same tension.

In this arrangement, however, the transmission lines 3-1 to 3-N for sending the tension instruction values TEsp1 to TEspN are required in correspondence with the tension apparatuses 1-1 to 1-N, respectively. This inevitably increases an amount of wiring material used. In addition, since the instruction units 2-1 to 2-N equal in number to the tension apparatuses 1-1 to 1-N are required, the system configuration becomes complex. Furthermore, adjustment of the tension instruction values TEsp1 to TEspN in the instruction units 2-1 to 2-N is cumbersome.

When the variation in generated, torque between the individual electromagnetic brakes incorporated in the tension apparatuses 1-1 to 1-N is reduced and the output torque can be accurately obtained. However, this impractically increases the manufacturing and assembly cost of the tension apparatuses 1-1 to 1-N.

SUMMARY OF THE INVENTION

It is an object of the present invention to provide a tension apparatus and tension system capable of accurately obtaining an output torque even when the generated torque varies between the individual built-in electromagnetic brakes.

It is another object of the present invention to provide a tension apparatus and tension system for reducing the manufacturing and assembly cost.

It is still another object of the present invention to provide a tension apparatus and tension system which have simple arrangements and do not use a large amount of wiring material.

In order to achieve the above objects, according to the present invention, there is provided a tension apparatus comprising a mechanical section having an electromagnetic brake driven by an exciting current to generate an output torque, the mechanical section applying a tension to a material in continuous form, which is being wounded and stretched, in accordance with the output torque of the electromagnetic brake, storage means for storing actually measured characteristics between an exciting current value and the output torque of the electromagnetic brake in advance, output torque calculation means for obtaining the output torque of the electromagnetic brake in correspondence with an input tension instruction value, and exciting current calculation means for obtaining an exciting current value of an exciting coil, which is necessary to generate the output torque of the electromagnetic brake, by looking up the storage means.

DESCRIPTION OF THE PREFERRED EMBODIMENTS

The present invention will be described below with reference to the accompanying drawings.

Figure 1:
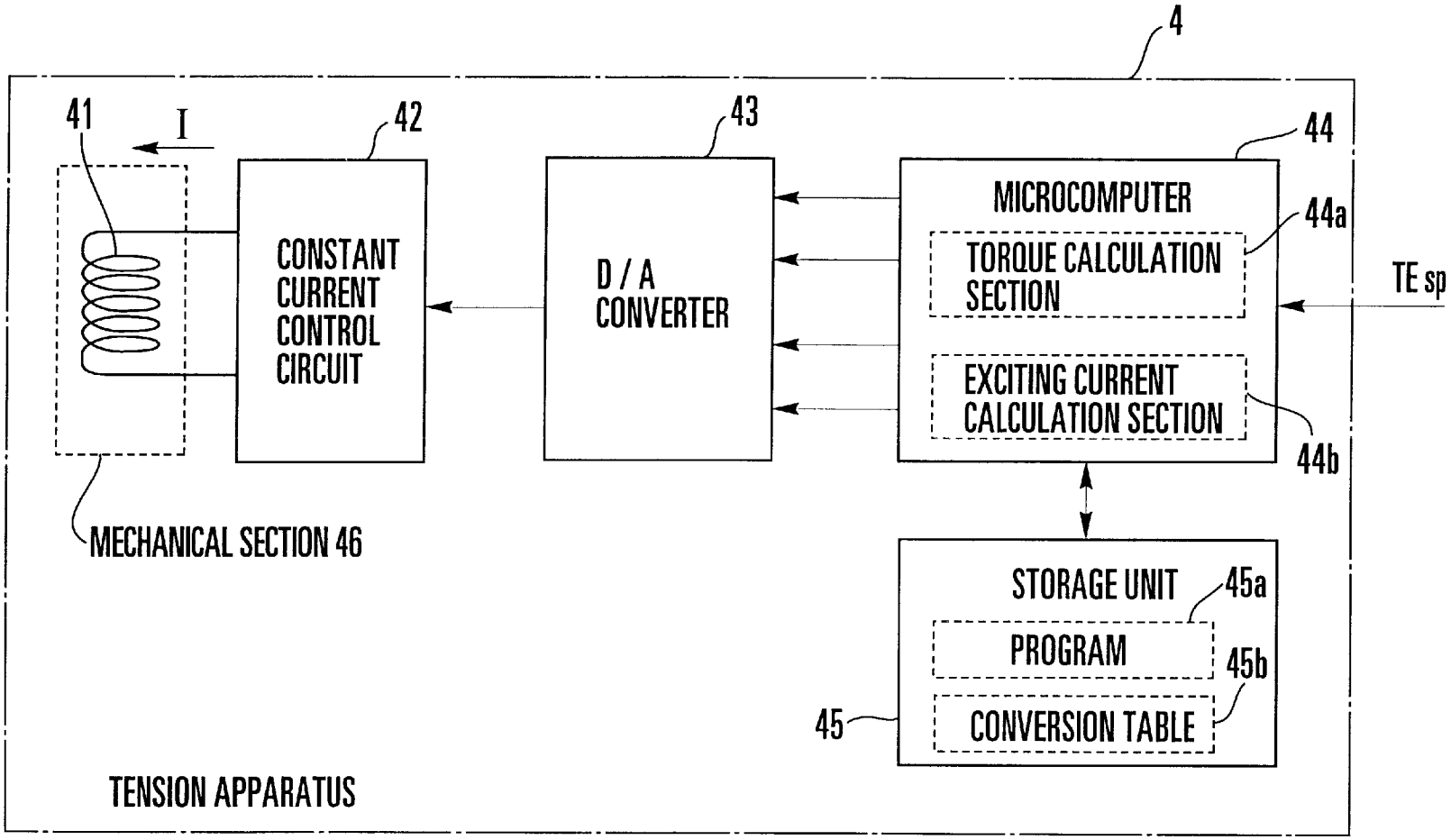
FIG. 1 is a block diagram showing the main part of a tension apparatus according to the first embodiment of the present invention.

FIG. 1 shows the main part of a tension apparatus according to the first embodiment of the present invention. Referring to FIG. 1, a tension apparatus 4 comprises a mechanical section 46 for applying a tension to a material in continuous form, which is being wound/stretched on the basis of the output torque of an electromagnetic brake 41, a constant current control circuit 42 for supplying an exciting current as a constant current to the electromagnetic brake 41, a D/A converter 43 for performing D/A (Digital/Analog) conversion of an input digital driving signal and outputting the analog signal to the constant current control circuit 42, a microcomputer 44 for outputting a digital driving signal to the D/A converter 43, and a storage unit 45 in which a program 45*a* to be executed by the microcomputer 44 and a conversion table (characteristic table) 45*b* are stored in advance.

The microcomputer 44 has a torque calculation section 44*a* for calculating the output torque of the electromagnetic brake 41, which is required in correspondence with an input tension instruction value TEsp, and an exciting current calculation section 44*b* for calculating the exciting current of the electromagnetic coil 41, which is required in correspondence with the output torque of the electromagnetic coil 41.

The mechanical section 46 is constructed by a pulley (tension roller) for winding a material in continuous form, the electromagnetic brake 41 of a hysteresis type for applying a rotational resistance to the pulley, and a pair of tenser discs, as disclosed in U.S. Ser. No. 09/162,847, now U.S. Pat. No. 6,029,923 (field Sep. 29, 1998) by the present assignee. For the details of the tension apparatus 4 including the mechanical section 46, the disclosure of U.S. Ser. No. 09/162,847, now U.S. Pat. No. 6,029,923 is incorporated in this specification.

The program 45*a* and conversion table 45*b* are commonly stored in the storage unit 45. However, they may be individually stored in two storage units.

Figure 2:
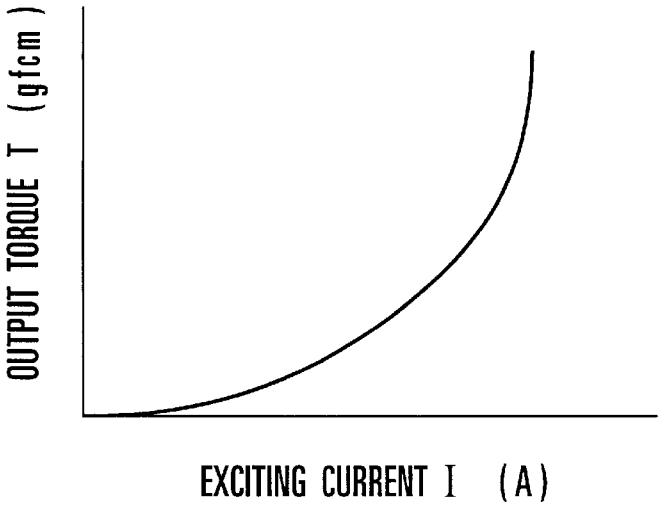
FIG. 2 is a graph showing the relationship between an exciting current I and an output torque T.

The conversion table 45*b* of the storage unit 45 stores characteristics representing the relationship between an exciting current I to the electromagnetic brake 41 and an output torque T from the electromagnetic brake 41, which is obtained by actual measurement in assembling the tension apparatus 4 in advance, as shown in FIG. 2. As is apparent from FIG. 2, the output torque T of the electromagnetic brake 41 is in positive correlation with the exciting current I but not in proportion to the exciting current I.

The microcomputer 44 operates as follows in accordance with the program 45*a* stored in the storage unit 45.

First, when the tension instruction value TEsp is supplied from an external unit, the torque calculation section 44*a* calculates the output torque T of the electromagnetic brake 41, which is required in correspondence with the tension instruction value TEsp. That is, the output torque T that is necessary to make a tension TE to be applied to the material in continuous form correspond to the tension instruction value TEsp is obtained.

The relationship between the tension instruction value TEsp and a generated torque T0 may be stored in the second conversion table different from the conversion table 45*b*, and the necessary output torque T corresponding to the tension instruction value TEsp may be obtained by looking up the second conversion table. The second conversion table may be stored in the storage unit 45 or another storage unit.

Next, the exciting current calculation section 44*b* obtains the exciting current I to the electromagnetic brake 41, which corresponds to the calculated output torque T, by looking up the conversion table 45*b* of the storage unit 45, and supplies the value of the exciting current I to the D/A converter 43 as a parallel digital signal.

The D/A converter 43 converts the digital signal representing the exciting current instruction value from the microcomputer 44 into an analog value (analog signal) and supplies it to the constant current control circuit 42. The constant current control circuit 42 controls the exciting current I to be supplied to the electromagnetic brake 41 in accordance with the analog value from the D/A converter 43.

Figure 3:
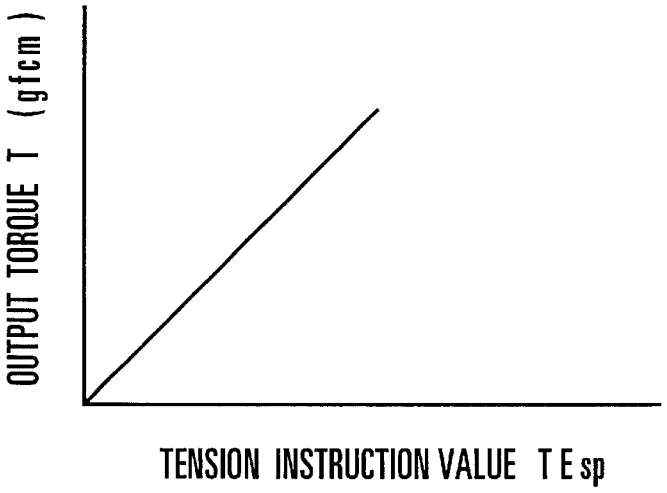
FIG. 3 is a graph showing the relationship between a tension instruction value TEsp and the necessary output torque T.
Figure 4:
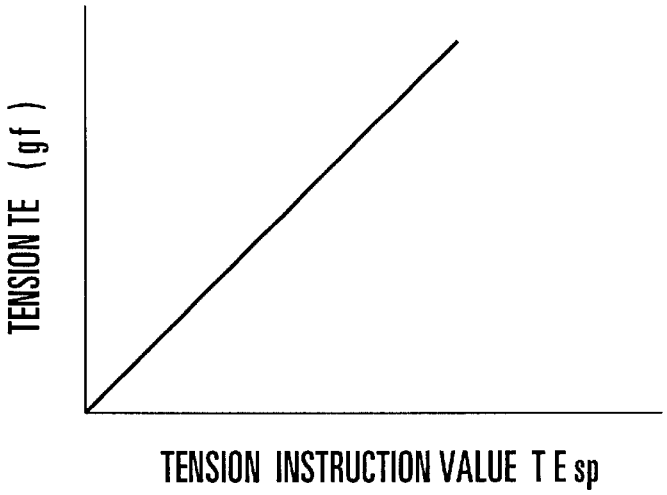
FIG. 4 is a graph showing the relationship between the tension instruction value TEsp and actually obtained tension TE.

As a result, as shown in FIG. 3, the output torque T corresponding to the input tension instruction value TEsp is linearly generated, so that the output torque T and tension instruction value TEsp are in proportion to each other. In addition, as shown in FIG. 4, the tension TE corresponding to the input tension instruction value TEsp is also linearly generated, so the tension TE and tension instruction value TEsp are in proportion to each other.

According to this embodiment, even when the generated torque varies on the basis of the difference between the individual built-in electromagnetic brakes 41, the output torque T is uniquely generated in correspondence with the input tension instruction value TEsp, and a desired tension TE can be accurately obtained. With this arrangement, even when the generated torques of the individual electromagnetic brakes 41 are slightly different from each other, this difference can be absorbed in use, and the manufacturing and assembly cost can be reduced.

Figure 5:
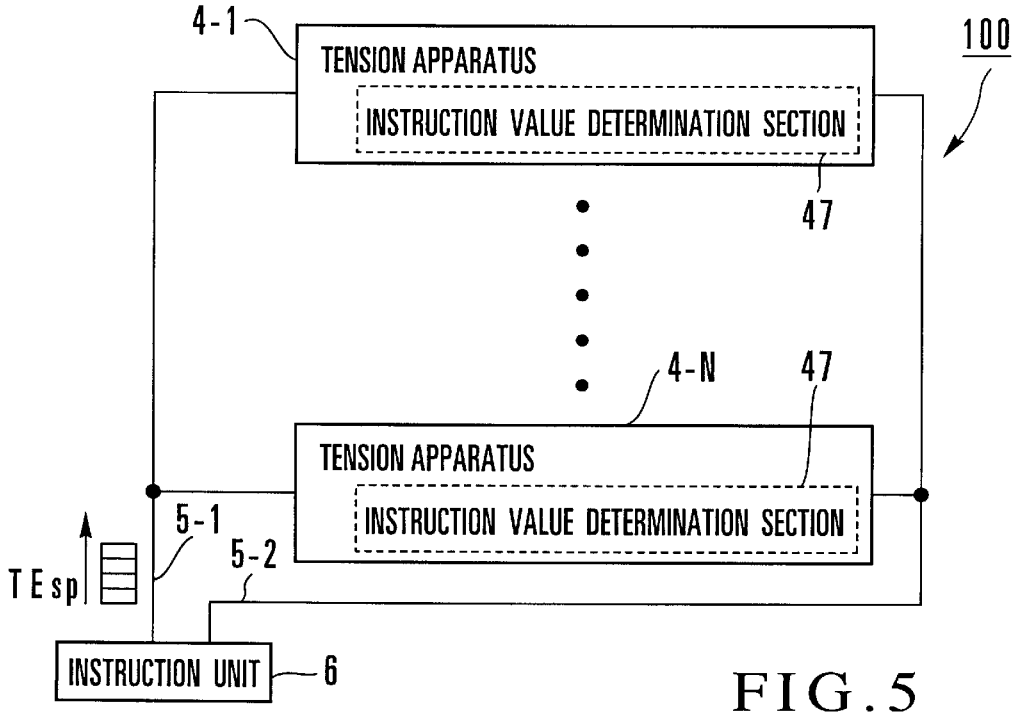
FIG. 5 is a block diagram showing the system configuration of a tension system according to the second embodiment of the present invention.

FIG. 5 shows the system configuration of a tension system according to the second embodiment of the present invention. N tension apparatuses 4-1 to 4-N (N is an integer, $N \geqq 2$) each constructed by adding an instruction value determination section 47 to the tension apparatus 4 shown in FIG. 1 are used.

In a tension system 100 shown in FIG. 5, the same tension instruction value TEsp is sent from an instruction unit 6 to the parallelly connected tension apparatuses 4-1 to 4-N through a pair of common signal lines (common transmission lines) 5-1 and 5-2. The tension instruction value TEsp is represented by a digital signal (digital value). Bit signals constructing this digital signal are serially transmitted to the tension apparatuses 4-1 to 4-N through the common signal lines 5-1 and 5-2.

The tension instruction value TEsp' from the instruction unit 6 is continuously transmitted to the tension apparatuses 4-1 to 4-N a plurality of number of times at a predetermined interval. In each of the tension apparatuses 4-1 to 4-N, the instruction value determination section 47 determines the regular tension instruction value TEsp from the tension instruction values TEsp' in accordance with decision by majority.

In each of the tension apparatuses 4-1 to 4-N, an exciting current I to be supplied to an electromagnetic brake 41 is individually obtained in accordance with the output torque of the electromagnetic brake 41, which is calculated from the regular tension instruction value TEsp, by looking up a conversion table 45*b* of a storage unit 45, as described above with reference to FIG. 1. That is, in each of the tension apparatuses 4-1 to 4-N, the corrected exciting current I to the electromagnetic brake 41 is obtained on the basis of the exciting current vs. output torque characteristics of an exciting coil 41 of each apparatus. Hence, the same output torque T can be obtained from the electromagnetic brakes 41 of the tension apparatuses 4-1 to 4-N in correspondence with the tension instruction value TEsp' which are supplied in common to the tension apparatus 4-1 to 4-N from the instruction unit 6.

According to the second embodiment, a simple system configuration can be realized without using a large amount of wiring material. In addition, the same tension can be simultaneously obtained by the tension apparatuses 4-1 to 4-N without any cumbersome adjustment by the instruction unit 6.

In this embodiment, the tension apparatuses 4-1 to 4-N have a long wiring length and are readily influenced by noise due to electromagnetic induction. However, since the instruction value determination section 47 determines the regular tension instruction value TEsp from the tension instruction values TEsp' in accordance with decision by majority, the reliability can be increased by preventing any erroneous operation due to noise by electromagnetic induction.

Figure 6:
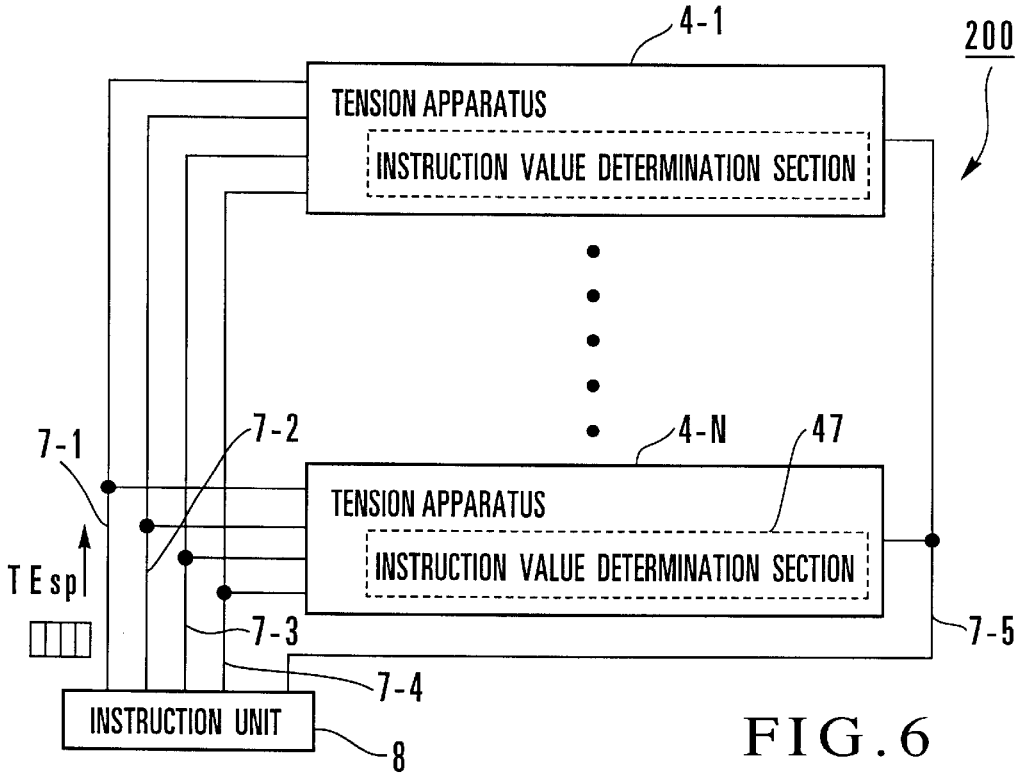
FIG. 6 is a block diagram showing the system configuration of a tension system according to the third embodiment of the present invention.
Figure 7:
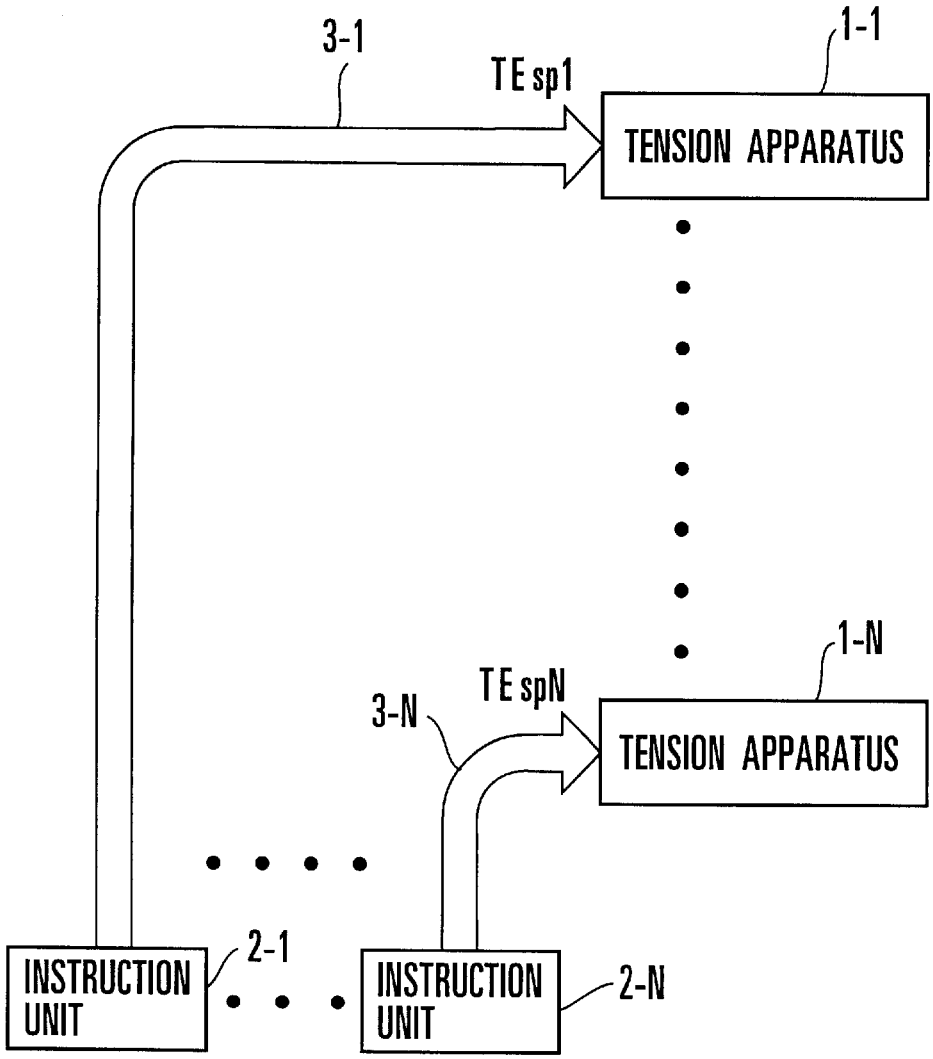
FIG. 7 PRIOR ART
FIG. 7 is a block diagram showing the system configuration of a conventional tension system.

FIG. 6 shows the system configuration of a tension system according to the third embodiment of the present invention. N tension apparatuses 4-1 to 4-N (N is an integer, $N \geqq 2$) each constructed by adding an instruction value determination section 47 to the tension apparatus 4 shown in FIG. 1 are used.

In a tension system 200 shown in FIG. 6, the N tension apparatuses 4-1 to 4-N are connected in parallel. The same tension instruction value TEsp' is sent from an instruction unit 8 to the tension apparatuses 4-1 to 4-N through a plurality of signal lines 7-1 to 7-5. The tension instruction value TEsp' is represented by a digital signal (digital value). A plurality of bit signals constructing the digital signal are parallelly transmitted to the tension apparatuses 4-1 to 4-N through the signal lines 7-1 to 7-5.

As in the second embodiment, the tension instruction value TEsp' is transmitted to the tension apparatuses 4-1 to 4-N through the signal lines 7-1 to 7-5 a plurality of number of times. In each of the tension apparatuses 4-1 to 4-N, the instruction value determination section 47 determines the regular tension instruction value TEsp from the tension instruction values TEsp' in accordance with decision by majority, so an exciting current I of an electromagnetic brake 41 is obtained by the regular tension instruction value TEsp.

As has been described above, according to the present invention, even when the generated torque varies on the basis of the difference between the individual built-in electromagnetic brakes, the output torques of the electromagnetic brakes are uniquely generated in correspondence with an input tension instruction value, and a desired tension can be accurately obtained. Hence, the variation in generated torque between the electromagnetic brakes can be corrected on signals, and the manufacturing and assembly cost can be reduced.

In addition, since a common tension instruction value is sent to the plurality of tension apparatuses through common transmission lines, a large amount of wiring material is not required. Furthermore, since the plurality of tension apparatuses automatically correct the exciting current, any cumbersome adjustment is required, and the same tension can be simultaneously generated.

What is claimed is:

1. A tension apparatus comprising:

a mechanical section having an electromagnetic brake driven by an exciting current to generate an output torque, said mechanical section applying a continuous tension in accordance with the output torque of the electromagnetic brake;

storage means for storing previously measured characteristics between the exciting current value and the output torque of said electromagnetic brake;

output torque calculation means for generating the output torque of the electromagnetic brake according to an input tension instruction value; and exciting current calculation means for generating the exciting current.

2. An apparatus according to claim 1, wherein said storage means comprises a characteristic table storing output torque versus exciting current value characteristics of the electromagnetic brake previously measured; and wherein the exciting current calculation means generates the necessary exciting current for the electromagnetic brake by looking up the characteristic table.

3. An apparatus according to claim 1, wherein said output torque calculation means generates the output torque of said electromagnetic brake from the tension instruction value.

4. An apparatus according to claim 1, wherein the exciting current calculation means determines the exciting current for the electromagnetic brake such that the output torque of said electromagnetic brake linearly changes with respect to the tension instruction value.

5. A tension system comprising:

a plurality of tension apparatuses; and an instruction unit for sending a single tension instruction value to all of the plurality of tension apparatuses through a common transmission line, each tension apparatus comprising:

a mechanical section having an electromagnetic brake driven by an exciting current to generate an output torque, the mechanical section applying a continuous tension in accordance with the output torque of the electromagnetic brake;

storage means for storing previously measured characteristics between the exciting current and the output torque of the electromagnetic brake;

output torque calculation means for generating the output torque of the electromagnetic brake according to the single tension instruction value; and exciting current calculation means for generating the exciting current.

6. A system according to claim 5, wherein the instruction unit simultaneously transmits a digital signal representing the single tension instruction value to the plurality of tension apparatuses through a serial transmission line.

7. A system according to claim 5, wherein the instruction unit simultaneously transmits a digital signal representing the single tension instruction value to the plurality of tension apparatuses through a parallel transmission line.

8. A system according to claim 5, wherein the instruction unit continuously transmits the single tension instruction value to the plurality of tension apparatuses a plurality of times, and wherein generating the output torque of the electromagnetic brake is done in accordance with the single tension instruction value that is received from the instruction unit a majority of the plurality of times.

9. A method comprising:

receiving a tension instruction value;

generating a desired output torque for an electronic brake according based on the tension instruction value;

determining an exciting current that will enable the electronic brake to produce the desired output torque; and continuously supplying the electronic brake with the exciting current necessary to maintain the desired output torque.

10. A textile tension apparatus comprising:

an electromagnetic brake generating an output torque in response to an exciting current;

a memory storing previously measured characteristics of the electromagnetic brake;

an input receiving an input tension instruction value;

a processor generating an exciting current value according to the input tension instruction value and the previously measured characteristics; and a converter receiving the exciting current value and supplying the exciting current to the electronic brake.

11. The apparatus of claim 10 wherein the processor comprises an output torque calculator and an exciting current calculator, wherein the output torque calculator determines a desired output torque according to the input tension instruction value and the exciting current calculator determines the exciting current value according to the desired output torque.

12. A tension system comprising:

an instruction unit; and a plurality of textile tension apparatuses, wherein the instruction unit delivers a common tension instruction value to all of the plurality of textile tension apparatuses, wherein each of the plurality of textile tension apparatuses comprise:

an electromagnetic brake generating an output torque in response to an exciting current;

a memory storing previously measured characteristics of the electromagnetic brake;

an input receiving the common input tension instruction value;

a processor generating an exciting current value according to the input tension instruction value and the previously measured characteristics; and a converter receiving the exciting current value and supplying the exciting current to the electronic brake.

13. The tension system of claim 12, wherein the instruction unit further delivers an intermittent sequence of common tension instruction values to the plurality of textile tension apparatuses.

14. The tension system of claim 13, wherein the processor of each of the plurality of textile tension apparatuses further comprises an instruction value determination section that receives the intermittent sequence of common tension instruction values and generates the exciting current according to a tension instruction value of the intermittent sequence of common tension instruction values that is received the most often.

15. The tension system of claim 12, wherein the instruction unit delivers the common tension instruction value in parallel to the plurality of textile tension apparatuses through a plurality of connections.

16. The tension system of claim 12, wherein the instruction unit delivers the common tension instruction value simultaneously a plurality of times to each of the plurality of textile tension apparatuses a plurality of times by using a plurality of lines connected between the instruction unit and each of the plurality of textile tension apparatuses.

* * * * *

UNITED STATES PATENT AND TRADEMARK OFFICE

CERTIFICATE OF CORRECTION

PATENT NO. : 6,257,518 B1
DATED : July 10, 2001
INVENTOR(S) : Mitsuhashi

It is certified that error appears in the above-identified patent and that said Letters Patent is hereby corrected as shown below:

Column 8,
Line 10, after "according to the" insert -- common --.

Signed and Sealed this

Twenty-first Day of May, 2002

*Attest:*

*Attesting Officer*

JAMES E. ROGAN
*Director of the United States Patent and Trademark Office*